US005688137A

United States Patent [19]

Bustance

[11] Patent Number: 5,688,137

[45] Date of Patent: Nov. 18, 1997

[54] ATHLETIC TRAINING DEVICE

[76] Inventor: William G. Bustance, 10329 Elk Lake Rd., Williamsburg, Mich. 49690

[21] Appl. No.: 672,987

[22] Filed: Jul. 1, 1996

[51] Int. Cl.[6] ..... A63B 69/00

[52] U.S. Cl. ..... 434/247; 2/115; 2/102; 2/913

[58] Field of Search ..... 434/247; 273/DIG. 30, 273/55 R; 482/83; 2/102, 115, 125, 913, 91 R

[56] References Cited

U.S. PATENT DOCUMENTS

| | | | |
|---|---|---|---|
| 4,058,852 | 11/1977 | Aragona | 273/DIG. 30 X |
| 4,658,442 | 4/1987 | Tomlinson et al. | 2/102 X |
| 4,747,779 | 5/1988 | Gerstung | 434/247 |

*Primary Examiner*—Jeffrey A. Smith

*Attorney, Agent, or Firm*—Douglas S. Bishop

[57] ABSTRACT

An athletic training device to keep an athlete's arms or legs in a releasably fixed position adjacent to the athlete's torso. The device is primarily for boxing, but has application in any sport where a "ready" position requires arms or legs to be held in a certain position in close proximity to the torso, prior to extending them in competition. The device consists of patches on the arms and on the torso which releasably engage each other utilizing material such as a velcro-type hook and loop assembly. The patches may be held on the torso and arms by separate vests or sleeves, or may be attached to one unitary garment such as a shirt. The position in which the arms or other extremities are held against the torso may be adjusted by placement of the removably engagable patches. The removably engagable feature allows the device to be worn in practice competition, because it holds the arms in appropriate "ready" position but, upon release, allows a full range of motion without incumbrance.

20 Claims, 3 Drawing Sheets

ATHLETIC TRAINING DEVICE

FIELD OF THE INVENTION

This invention relates to athletic training devices, and more specifically, to athletic training devices for teaching an athlete particular initial or "ready" positions relative to the athlete's arms, hands, legs or feet relative to the athlete's torso. While the present invention may have application to many different sports, it is particularly adapted to the sport of boxing.

BACKGROUND OF THE INVENTION

The utilization of straps or other restraining devices to hold a portion of an athlete's body in a particular position is known. For example, U.S. Pat. No. 3,738,654, to Whaley, Jr., describes a body restraining device comprised of strap elements designed to be worn by a player in a sport such as football, to draw the head and shoulders down in order to maintain an advantageous, crouching position.

Various other sports, such as boxing, require extensive training to keep the athlete's arms in a proper, balanced position preparatory to delivering a blow or executing another offensive or defensive maneuver.

In boxing, it is critically important that a boxer keep the arms in a ready or "locked" position when they are not extended to feint, deliver or block a blow. Keeping the arms close to the body helps maintain balance and is particularly important when a boxer begins to tire. A tiring boxer will begin to lose balance as the arms drift away from the body and will tend to cock the arm farther back than it should be, overloading the ability to punch. In such a situation, the boxer will also lose speed because the punches are no longer traveling the shortest possible distance. The natural instincts of a boxer tend to force the boxer to punch out of balance. It is these instincts which must be harnessed and overcome to be a disciplined boxer and to improve.

Proper training techniques and devices are designed to improve speed, power and balance. Heavybags, speed bags, double-end bags, shadow boxing, balancing exercises and weight and resistance training have been used to enhance speed balance and power. None of these training devices or techniques, however, enhances speed, balance and power simultaneously.

The problem of teaching a boxer to keep the arms against the torso in a "ready" position, has been one of longstanding without a truly satisfactory resolution. Trainers have used various methods to attempt to solve this dilemma. These methods include yelling at the boxer continually to keep the arms or elbows "in." Another method has been to utilize rope, straps or tape to tie a boxer's arms to the boxer's side just above the elbows to shorten the boxer's motion. In this technique, the boxer's weaker, "jab" or forward hand is released from the binding initially, forcing the boxer to keep a proper angle and balance by keeping the strong or "power" hand locked against the trunk of the body. Boxers and trainers have even used newspapers between the boxer's arms and sides, requiring the boxer to keep the arms pressed against the sides to prevent the newspaper from falling. Another device which has been used connects the boxer's upper arms, above the elbows, with surgical tubing to keep the boxer's arms at the sides while shadow boxing.

None of the existing devices and techniques, however, allow a boxer to address the areas of power, speed and balance simultaneously. They cannot be used in all phases of a workout with the resulting consequence that a boxer may regain bad habits in moving from one exercise to the next. The external devices currently utilized, also, prohibit a boxer from a full range of motion and, apart from the specific function they are designed to accomplish may actually provide unwanted resistance or incumbrance to other proper movements which may be a distraction and even counter-productive. Further, such devices, to the extent that they include restraining straps or the like or otherwise, prevent a full range of motion and may be dangerous and limiting if used in sparring or other competitive situations.

Accordingly, a need exists for an athletic training device, specifically adaptable to boxing which may be worn by a boxer through an entire workout designed to improve and enhance the boxer's speed, balance and power.

An optimal training device for such purposes must be one which will encourage a boxer to punch straight and to punch efficiently in all phases of a workout.

An optimal training device for such purposes must be one which will allow a boxer to improve the boxer's weak or "jab" hand skills and yet allow the boxer to punch and cross with the boxer's strong hand without incumbrance.

An optimal training device for such purposes must be one which may be worn by the boxer in actual sparring and practice competition without limiting the boxer's ability to defend. It must additionally allow the boxer to return to the ready or locked position between punches or extentions without stopping the workout, match or sparring session.

As noted, existing, singular training devices and techniques fail to satisfy these requirements.

SUMMARY OF THE INVENTION

The present invention has been designed to overcome the shortcomings in the prior art noted above.

The invention is directed to the provision of an athletic training device, generally for any sport which requires one or more arms or legs to be held in and extended from, a position in close proximity to the user's body, and more specifically, for the sport of boxing.

A more specific object is to provide a boxing training device which may be worn throughout an entire workout, to enhance a boxer's speed, balance and power.

A further specific object of the invention is to provide a boxing training device which will hold a boxer's arms, and hands in a correct locked, or "ready," position against the boxer's body, which will encourage a boxer to punch straight and to punch efficiently in all phases of a workout, and which will allow improvement of weak or jab hand skills and improvement of all strong hand skills without incumbrance or alternating of devices.

A further key object to which the present invention is directed is the provision of training device meeting the criteria outlined above which may be worn in actual competition or sparring and which, by not impeding the boxer's full extention or range of motion and by not limiting the boxer's ability to defend, will not place the boxer at undue risk of injury or encourage unnatural or improper techniques.

The device of the present invention may be used by a boxer throughout an entire workout, including sparring or practice competition. The device includes corresponding resistance members or patches which are releasably engagable, attached to the boxer's body and to the boxer's upper arms. The patch, on each arm, engages a patch on the body to hold the boxer's arms against the body in a desired position to maintain appropriate body balance and angle for boxing. The engagement of the arm and body patches may be by a severable hook and loop assembly (with one patch being of hook material and the corresponding patch of loop material) or other suitable means for holding the patches together, but allowing them to separate upon the application of appropriate force. The engagement means has sufficient resistance to prevent movement of the boxer's arms away from the body except by intended voluntary thrust or extention by the boxer.

According to a further important feature of the invention, the patches attached to the boxer's body may be positioned so that the boxer's weak or jab hand is in an appropriate leading position and the boxer's strong hand is likewise in an appropriate position so that the boxer automatically assumes a correct angle and posture in taking a stance.

According to a further feature of the invention, the attachment patches may be affixed to the boxer's body by means of a vest, belt or other garment which encircles the boxer's torso and upon which the attachment patches are fixed. The attachment patches for each of the boxer's arms may be attached by affixing them to bands around the arms.

In one preferred embodiment of the device of the present invention, a sleeveless vest is utilized. The vest attaches in the front by buttons, ties, hook and loop fasteners, or other fastening means. A patch of the loop element material of a hook and loop fastening assembly is sewn or otherwise attached to the vest at approximately breast level and disposed toward the user's side for whichever would be the boxer's lead hand (in the case of a right-handed boxer, the left hand). A second patch of such material is likewise attached to the other side of the vest at a lower position and more disposed toward the front of the boxer, when the vest is worn, on the side of the boxer's strong hand. The patches of the hook material of the hook and loop assembly are likewise attached, one each, to bands around the boxer's arm. These bands may be of a continuous loop of elastic or other resilient material, or may be of a one piece strap arrangement, which may be fixed around the boxer's arm by means of fastening devices located on each end of the strap, such as snaps, ties, or a velcro type hook and loop fastener.

In another variation of a preferred embodiment of the invention, the device may be constructed as a one piece garment of expandable material with the hook and loop patches affixed in the same position as to the boxer's body, but with the hook and loop patches for the arms being placed in a like position on the sleeves of the garment. Such a garment may be of the "slip over" type, or, additionally, may have an open front, with fasteners to close the device around the boxer's body when worn.

According to a further feature of the invention, attachment patches which comprise the loop element of the severable hook and loop assembly are removable, for replacement or otherwise. The loop portion in such cases is removably affixed to the vest or other body element by an assembly, which has a base portion of loop material which is affixed to the vest member with the loop element of the severable hook and loop assembly centered on that base portion but having a lesser width and lesser length dimension than the base portion of loop fabric attached directly to the vest. The loop portion or element of the severable hook and loop assembly is held in position on the base portion by a border member of hook material of sufficient width to contact the outer edges of the base portion which is affixed to the vest and the outer dimensions of the loop element of the severable hook and loop assembly which is centered on that base portion. Such a border extends around the entire perimeter of the loop material. The loop element of the hook and loop assembly is thus replaceable by removing the hook material border member and substituting a new loop element. As a further preferred embodiment of the invention, a padding material may be placed beneath the loop element attachment patch, which facilitates contact between the loop portion and hook portion of a hook and loop assembly.

When the device is worn by the boxer, as the boxer assumes a ready, or locked, position, the upper arm of the boxer's weak, or forward hand, is held against the boxer's side so as to hold the boxer's forearm and hand at a desired lead position away from the body. The upper arm of the boxer's strong, or normally dominant, hand is held at a lower position on the body and more central to the front of the boxer's body, automatically placing the boxer in the correct stance with his arms and body in proper posture and angle. The velcro assembly, or other fastening material, allows the boxer to throw a punch from the locked position, but holds the boxer in position prior thereto and prevents involuntary movement of the arms away from the body. In the present invention, after a boxer has extended the arms from the body to throw a punch or otherwise, when the boxer returns to the correct stance, the arms are again automatically held in place by the hook and loop or other element.

The above and additional features of the invention may be considered and will become apparent in conjunction with the drawings in particular, and the detailed description which follow.

BRIEF DESCRIPTION OF THE DRAWINGS

The following detailed description is best understood by reference to the following drawings in which.

DETAILED DESCRIPTION OF THE PREFERRED EMBODIMENT

Throughout the following detailed description, like numerals are used to reference the same element of the present invention shown in multiple figures thereof.

Figure 1:
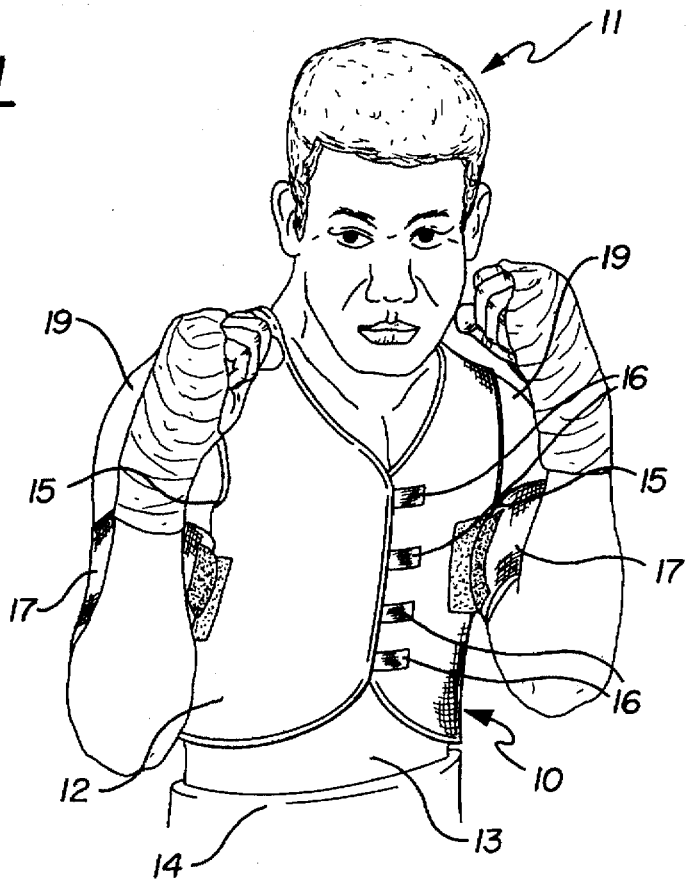
FIG. 1 is a perspective front view of a boxer wearing the invention device configured in a left-handed "ready" position.
Figure 2:
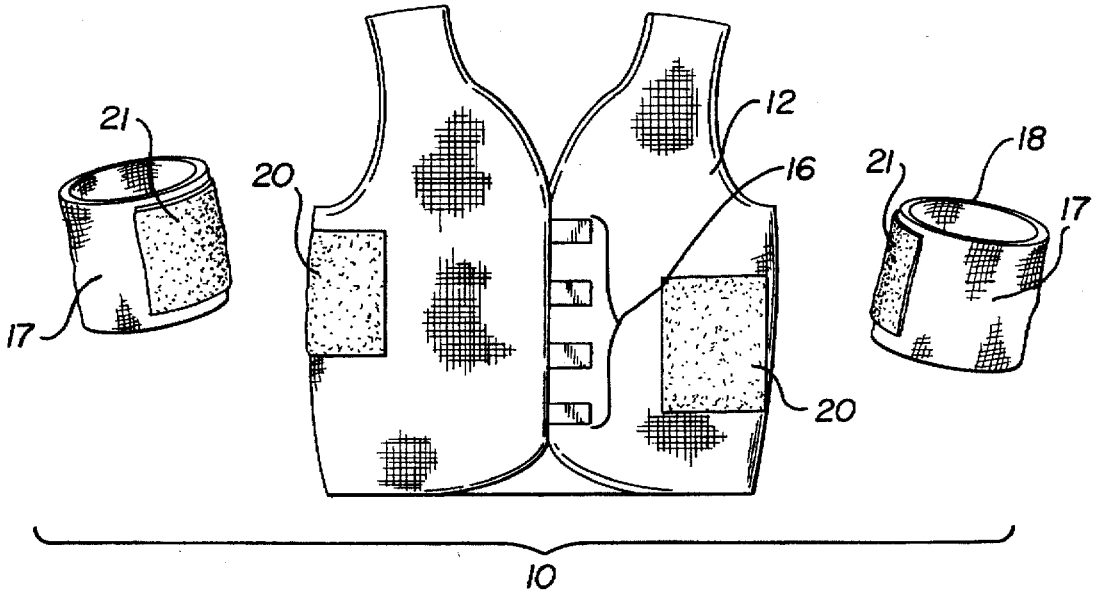
FIG. 2 is a front perspective view of the components of the device.

Referring now to the drawings, and in particular, to FIGS. 1 and 2, there is shown an athletic training device 10 for use and to be worn by a boxer 11. The device 10 includes a vest element 12 which encircles the torso 13 of the boxer 11 above the waist 14 and below the armpits 15. The vest 12 may be closed about the boxer's 11 torso 13 by one fastner 16 which may be a snap, tie, severable hook and loop assembly; or other means. The device 10 additionally includes a pair of sleeve elements 17. Each sleeve element 17 may be a one piece loop 18 construction of an elastic or otherwise expandable material. Alternatively, each may be a one piece strap element having corresponding fastening means at each end, such as a snap, tie, severable hook and loop, or other means to secure the sleeve element 17 about the arm 19 of the boxer.

Affixed to the vest element 12 are two first attachment means 20 which in the preferred embodiment may be the loop portion of a severable hook and loop assembly.

Affixed to each of the sleeve elements 17 is a second attachment member 21, which in the preferred embodiment may be the hook portion of a severable hook and loop assembly.

In the preferred embodiment, however, the purpose of the invention is equally served with the respective hook portions and loop portions of a severable hook and loop assembly being interchangeable between first attachment means 20 and second attachment means 21, so long as either first attachment means 20 or second attachment means 21 is the loop portion and the other is the hook portion.

The first attachment means 20 are releasably engagable with the corresponding second attachment means 21. In the preferred embodiment of the invention, the releasable engagement of any first attachment means 20 and any corresponding second attachment means 21 may be released or severed by the voluntary extention of the boxer's 11 arm 19 away from the boxer's 11 torso 13. In the preferred embodiment of the invention, the releasably engagable attachment of a first attachment member 20 and a second attachment member 21 may be released or severed by a force of between one-half and three pounds per square inch of releasable engagement of the respective hook and loop of the portions of first engagement member 20 and second engagement member 21. Thus, when the boxer 11 is in a ready locked position as shown in FIG. 1, the releasable engagement of a first attachment member 20 and a second attachment member 21 is of sufficient resistance to prevent involuntary extention of the boxer's 11 arm 19 away from the torso 13, yet permits voluntary extention of an arm 19 away from the boxer's 11 torso 13. Obviously, should it be desireable for any purpose, the resistance of such releasably engagable attachment may be increased to require a greater force to release or sever the engagement.

Figure 3:
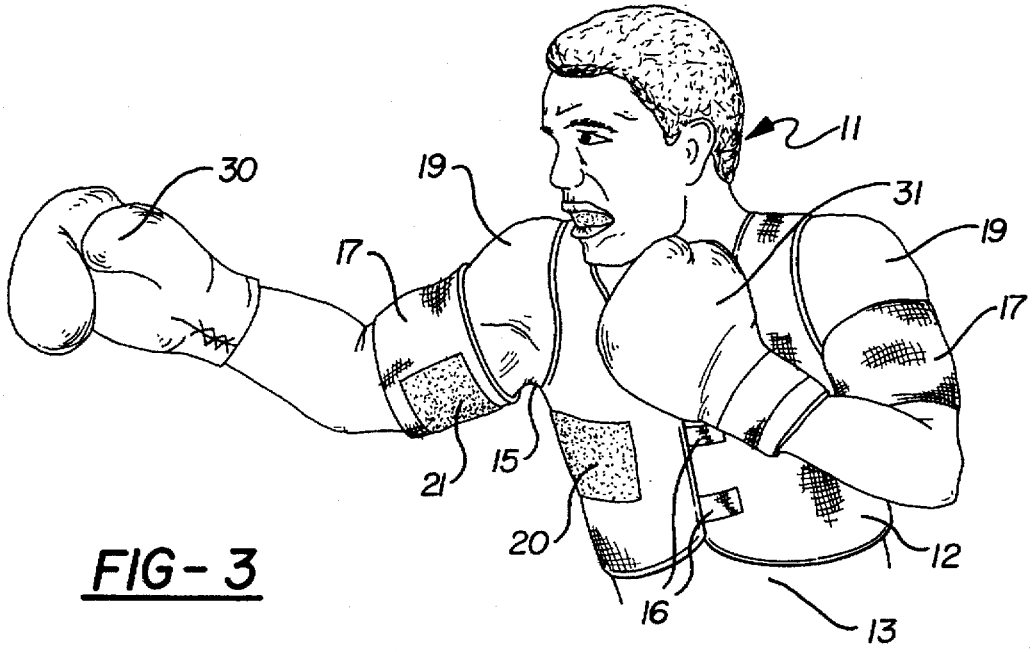
FIG. 3 is a side perspective view of a boxer utilizing the invention device configured for a left-handed boxer with corresponding attachment members for the boxer's right-hand disengaged and corresponding attachment members for the boxer's left hand engaged.
Figure 4:
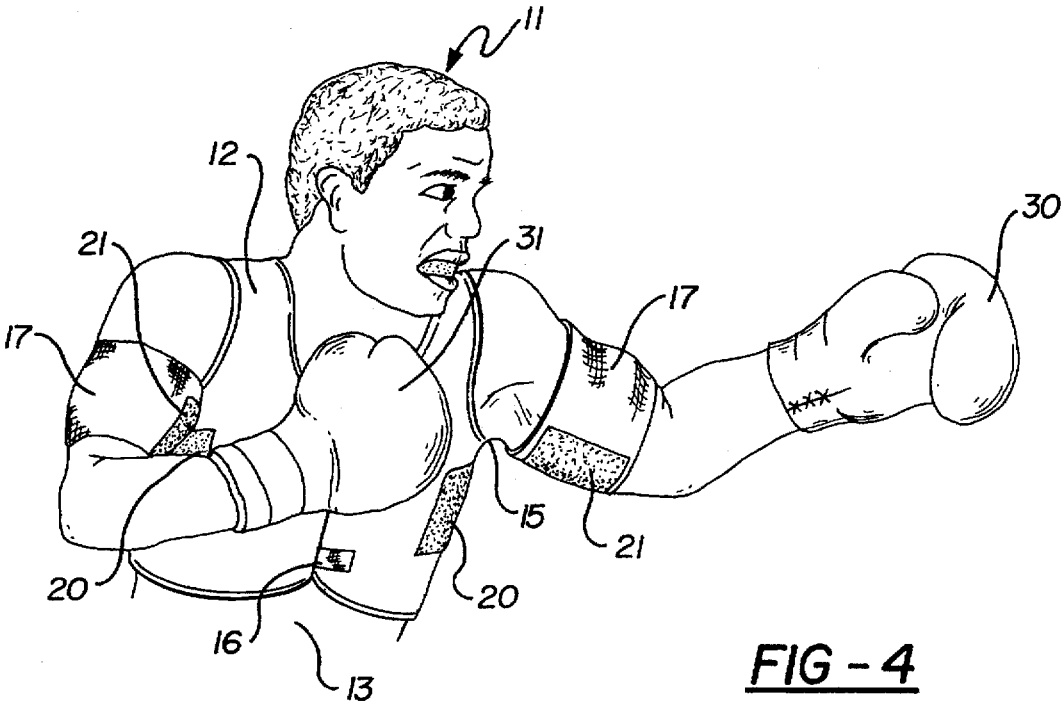
FIG. 4 is a side perspective view of a boxer utilizing the invention device configured for a right-handed boxer with corresponding attachment members for the boxer's left hand disengaged and corresponding attachment members for the boxer's righthand engaged.

FIGS. 3 and 4, respectively, show a boxer 11 wearing the device 10 configured for a left-handed boxer 11 and a right-handed boxer 11, with lead hand 30 extended and strong hand 31 held in proximity to the boxer's 11 side by the releasably engagable attachment of first attachment means 20 and second attachment means 21.

Figure 5:
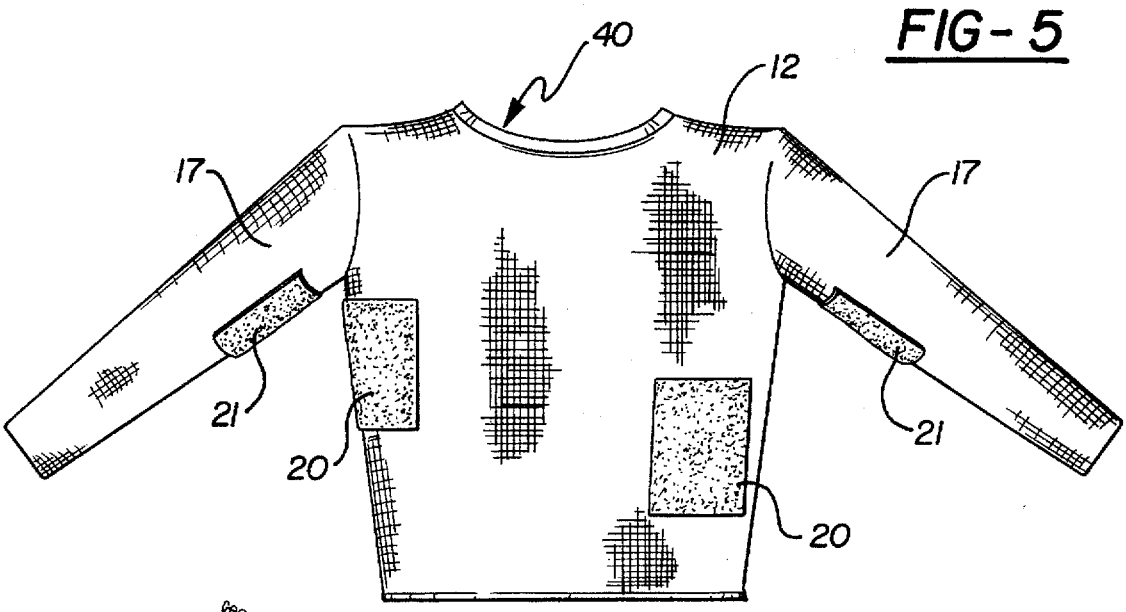
FIG. 5 is a front perspective view of the invention embodied in a one-piece garment.

FIG. 5 shows another version of the preferred embodiment of the device 10, configured as a one piece garment 40 combining the features of the vest element 12 and sleeve elements 17. The garment 40 may be constructed as a one piece, pullover device as shown in FIG. 5, or alternatively, may close about the torso 13 of the boxer 11 in the same manner as shown for the vest element 12.

First attachment members 20 and second attachment members 21 may also be affixed in desired positions on the boxer's torso 13 and arms 19 or other extremities, by means independent of the vest element 12 and sleeve elements 17. Thus, the invention in its simpliest form may comprise a first attachment member 20 affixed by any means to the torso 13 of the boxer 11 with a second attachment member 21 affixed by any means to any extremity of the boxer 11 with said first and second attachment members 20 and 21, respectively, being releasably engagable, as stated initially above for the preferred embodiment. The first attachment members 20 may be utilized singularly, or in greater numbers and placed at any desired position on the boxer's 11 torso 13. Likewise, the second attachment members 21 may be utilized singularly or in greater number and placed at any desired position on the boxer's 11 arms 19 or other extremities. Thus, the particular extremity and the portion of the body against which it is to be removably held may be selected and adjusted as necessary for the particular application or for the particular size and physique of the individual boxer.

As may be readily seen from the drawing, the ready position of Figure allows extention of the boxer's 11 arms 19 as shown in FIGS. 3 and 4, and the releasably engagable feature of the first attachment means 20 and second attachment means 21 allows the boxer 11 to retract into the initial position and re-engage said attachment members 20 and 21 without cessation of training.

Figure 6:
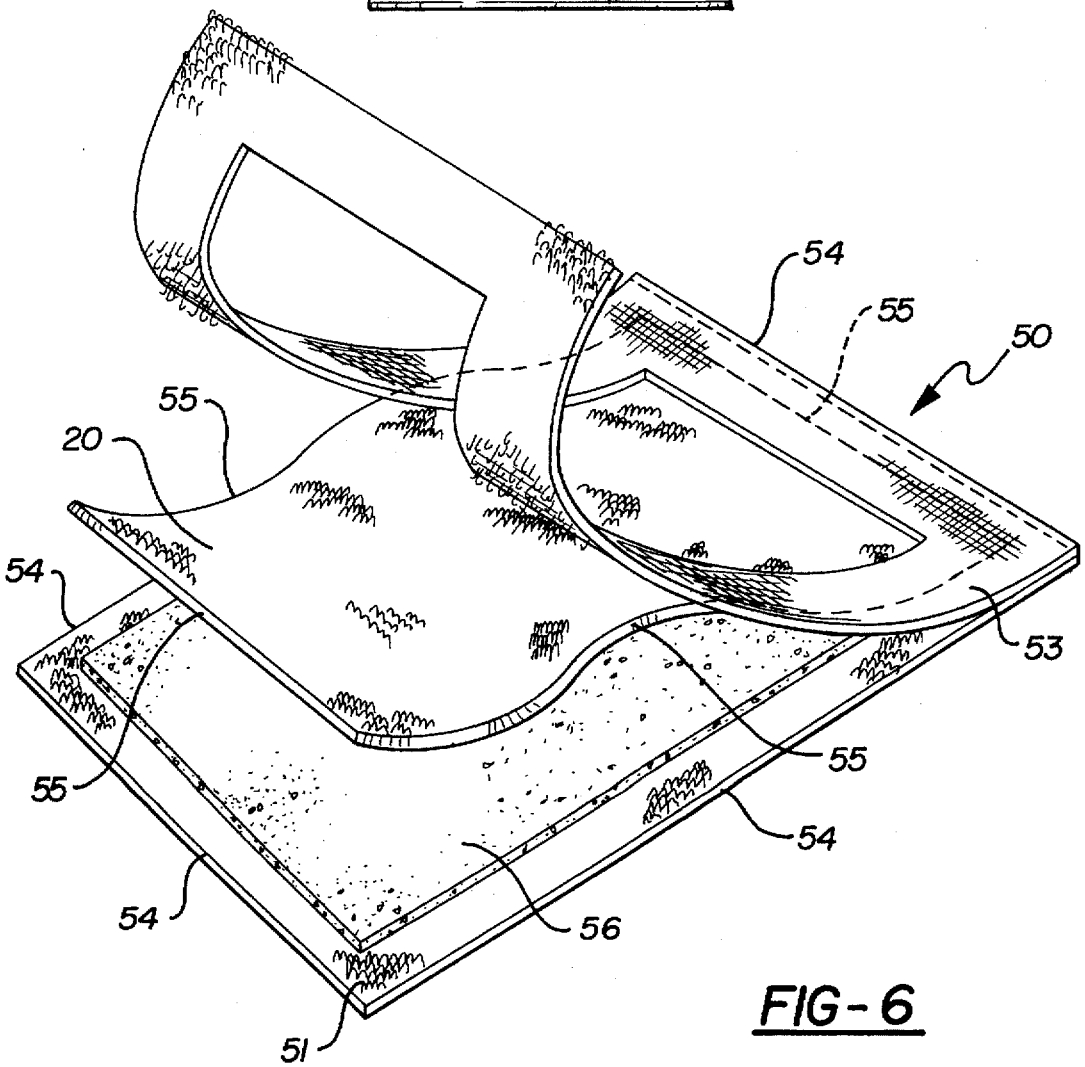
FIG. 6 is a perspective view of an attachment member of the invention comprising the loop component of a hook and loop fastening system, wherein the loop material is replaceable.

In the preferred embodiment of the invention, the first attachment member 20, which comprises the loop element, of a severable hook and loop assembly is removable, as shown in FIG. 6. Said first attachment member 20 is removably affixed to the vest 12 by an assembly 50, wherein a base element 51, comprised of loop material, is affixed to the vest member 12, with the first attachment member 20 centered on said base element 51 with said first attachment member 20 having a lesser width and lesser length dimension than the base element 51 and additionally comprising the loop portion of a severable hook and loop assembly. The first attachment member 20 comprising the loop portion of the severable hook and loop assembly is held in position on the base element 51 by a border member 53 comprised of hook material of sufficient width to contact the outer edges 54 of the base element 51 affixed to the vest 12 and the outer dimensions 55 of the first attachment member 20 as centered on the base element 51. Such border member 53 extends about the entire perimeter 55 of the first attachment member 20. Said first attachment member 20, the loop portion of the severable hook and loop assembly, is thus replaceable by removing the border member 53 and substituting a new first attachment member 20. In a further preferred embodiment of the invention, a padding material 56, may be placed beneath the first attachment member 20 to facilitate contact of the loop portion and hook portion of the hook and loop assembly.

It is the claims appended hereto and all reasonable equivalents thereof which define the true scope of the invention rather than the depicted embodiments and exemplification.

What is claimed is:

1. An athletic training device for releaseably holding a user's extremity in a desired position against the user's body comprising:

a plurality of first attachment members;

a first means for affixing said first attachment members at a corresponding plurality of positions on the torso of the user;

a second attachment member;

a second separate means for affixing said second attachment member to an extremity of the user; and one of said first attachment members is releaseably engageable with said second attachment member.

2. An athletic training device according to claim 1, wherein the means for affixing said first attachment members to the torso of the user further comprises:

a member for encircling a portion of the user's torso; and said first attachment means is affixed to said encircling member.

3. An athletic training device according to claim 1, wherein the means for affixing said second attachment member to an extremity of the user further comprises:

a member for encircling said extremity; and said second attachment means is affixed to said encircling member.

4. An athletic training device according to claim 1, wherein each of said first attachment members may be affixed to the user's torso at one of a plurality of positions.

5. An athletic training device according to claim 1, wherein said device further comprises:

a plurality of second attachment members;

a second separate means for affixing each of said second attachment members to one of a plurality of extremities of the user; and each of said second attachment members is releaseably engageable with one of said first attachment members.

6. An athletic training device according to claim 1, wherein the releasable engagement of said first and second attachment members is of sufficient resistance to prevent involuntary extension of the user's extremity away from the user's torso.

7. An athletic training device according to claim 1, wherein the releasable engagement of said first and second attachment members permits voluntary extension of the user's extremity away from the user's torso.

8. An athletic training device according to claim 1 wherein one of the first attachment members comprises a first portion and the second attachment member comprises a complementary second portion of a severable hook and loop assembly.

9. An athletic training device according to claim 1, wherein the referenced extremity is the user's arm.

10. An athletic training device for releaseably holding a user's extremity in a desired position against the body comprising:

a member for encircling a portion of the user's torso;

a pair of first attachment members affixed to said torso encircling member;

a pair of members, each of which is separate from said torso encircling member and is for encircling one arm of the user;

a pair of corresponding second attachment members, one of which is affixed to each of said arm encircling members;

each of said first attachment members being releaseably engageable with a corresponding second attachment member.

11. An athletic training device according to claim 10, wherein the torso encircling member has an upper end, a lower end and two opposing sides; and wherein each of the pair of first attachment members is affixed to the torso encircling member at different positions relative to the upper end, lower end, and sides of the torso encircling member.

12. An athletic training device according to claim 10, wherein said first attachment members may be affixed to said torso encircling member at a plurality of positions.

13. An athletic training device according to claim 10, wherein the releasable engagement of said first and second attachment members is of sufficient resistance to prevent involuntary extention of the user's arms away from the user's torso.

14. An athletic training device according to claim 10, wherein the releasable engagement of said first and second attachment members permits voluntary extention of the user's arms away from the user's torso.

15. An athletic training device according to claim 10, wherein the means of releasable engagement between each first attachment member and corresponding second attachment member comprises a severable hook and loop assembly wherein one attachment member is the hook portion and the corresponding attachment member is the loop portion.

16. An athletic training device according to claim 10, wherein the member for encircling a portion of the user's torso comprises a sleeveless vest assembly.

17. An athletic training device according to claim 10, wherein said arm encircling members each further comprises a means of maintaining continuous circular contact.

18. An athletic training device according to claim 10, wherein each said arm encircling member comprises an individual strap with a pair of opposite ends having corresponding fastening means at said opposing ends.

19. An athletic training device according to claim 10, wherein said first attachment members comprise the loop portion of a severable hook and loop assembly and, wherein, said first attachment members are each removeably affixed to said torso encircling member by means further comprising a hook and loop assembly, wherein:

a base attachment member of loop material is affixed to the torso encircling member;

said first attachment member comprises a unit of loop material having lesser width and length dimension than said base member and centered on said base member;

a cover member of hook material having an outer dimension substantially equal to the outer dimension of said base member and the inner dimensions of said cover member defining an aperture having height and width dimensions less than the outer dimensions of said first attachment member; and the hook material of said cover member being releaseably engageable with the loop material of said base member and the loop material of said first attachment member.

20. An athletic training device according to claim 19, wherein said device additionally comprises a pad member between said base attachment member and first attachment member.

* * * * *